US006029022A

United States Patent [19]

Takase

[11] Patent Number: 6,029,022

[45] Date of Patent: Feb. 22, 2000

[54] IMAGE FORMING APPARATUS

[75] Inventor: Makoto Takase, Okazaki, Japan

[73] Assignee: Minolta Co., Ltd., Osaka, Japan

[21] Appl. No.: 09/154,024

[22] Filed: Sep. 16, 1998

[30] Foreign Application Priority Data

Sep. 17, 1997 [JP] Japan ..... 9-251808
Jul. 2, 1998 [JP] Japan ..... 10-187416

[51] Int. Cl.[7] ..... G03G 15/16

[52] U.S. Cl. ..... 399/66; 399/299; 399/306; 399/9

[58] Field of Search ..... 399/66, 299, 306, 399/9

[56] References Cited

U.S. PATENT DOCUMENTS 5,128,717 7/1992 Uchikawa et al. .
5,600,421 2/1997 Takekoshi et al. ..... 399/66

FOREIGN PATENT DOCUMENTS 07271107 10/1995 Japan .

OTHER PUBLICATIONS

*Patent Abstracts of Japan*, vol. 96, No. 3(CD–ROM) For Document JP 08069188A, Mar. 1996.

*Primary Examiner*—Richard Moses
*Attorney, Agent, or Firm*—McDermott, Will & Emery

[57] ABSTRACT

The object of the present invention is to provide an image forming apparatus capable of producing excellent images without transfer irregularities regardless of impedance fluctuation dependent on transfer timing, and which avoids enlargement of the apparatus.

The aforesaid objects are attained by the image forming apparatus of the present invention which sequentially transfers toner images formed by a plurality of image forming units onto the same transfer sheet via a plurality of transfer charging means, wherein transfer output is controlled in accordance with the change of impedance of the transfer area dependent on the timing of each transfer.

24 Claims, 14 Drawing Sheets

FIG. 8

OHP ( plastic film )

Heavy Paper

Plain Paper

| Humidity ($g/m^3$) | Transfer Power | | | |
|---|---|---|---|---|
| | Cyan | Magenta | Yellow | Black |
| 0~4 | $C_1$ | $M_1$ | $Y_1$ | $K_1$ |
| ~6 | $C_2$ | $M_2$ | $Y_2$ | $K_2$ |
| ~8 | $C_3$ | $M_3$ | $Y_3$ | $K_3$ |
| ~10 | $C_4$ | $M_4$ | $Y_4$ | $K_4$ |
| ~12 | $C_5$ | $M_5$ | $Y_5$ | $K_5$ |
| ~14 | $C_6$ | $M_6$ | $Y_6$ | $K_6$ |
| ~16 | $C_7$ | $M_7$ | $Y_7$ | $K_7$ |
| ~18 | $C_8$ | $M_8$ | $Y_8$ | $K_8$ |
| ~20 | $C_9$ | $M_9$ | $Y_9$ | $K_9$ |
| ~22 | $C_{10}$ | $M_{10}$ | $Y_{10}$ | $K_{10}$ |
| ~24 | $C_{11}$ | $M_{11}$ | $Y_{11}$ | $K_{11}$ |
| 24~ | $C_{12}$ | $M_{12}$ | $Y_{12}$ | $K_{12}$ |

FIG. 9

OHP ( 297 mm or more )

Heavy Paper ( 297 mm or more )

Plain Paper (297 mm or more)

| Humidity ($g/m^3$) | Transfer Power | | | |
|---|---|---|---|---|
| | Cyan | Magenta | Yellow | Black |
| 0~4 | $C_1'$ | $M_1'$ | $Y_1'$ | $K_1'$ |
| ~6 | $C_2'$ | $M_2'$ | $Y_2'$ | $K_2'$ |
| ~8 | $C_3'$ | $M_3'$ | $Y_3'$ | $K_3'$ |
| ~10 | $C_4'$ | $M_4'$ | $Y_4'$ | $K_4'$ |
| ~12 | $C_5'$ | $M_5'$ | $Y_5'$ | $K_5'$ |
| ~14 | $C_6'$ | $M_6'$ | $Y_6'$ | $K_6'$ |
| ~16 | $C_7'$ | $M_7'$ | $Y_7'$ | $K_7'$ |
| ~18 | $C_8'$ | $M_8'$ | $Y_8'$ | $K_8'$ |
| ~20 | $C_9'$ | $M_9'$ | $Y_9'$ | $K_9'$ |
| ~22 | $C_{10}'$ | $M_{10}'$ | $Y_{10}'$ | $K_{10}'$ |
| ~24 | $C_{11}'$ | $M_{11}'$ | $Y_{11}'$ | $K_{11}'$ |
| 24~ | $C_{12}'$ | $M_{12}'$ | $Y_{12}'$ | $K_{12}'$ |

FIG. 10

OHP ( 297 mm or more )

Heavy Paper ( 297 mm or more )

Plain Paper (297mm or more)

| Humidity ($g/m^3$) | Transfer Power | | | |
|---|---|---|---|---|
| | Cyan | Magenta | Yellow | Black |
| 0~4 | C1" | M1" | Y1" | K1" |
| ~6 | C2" | M2" | Y2" | K2" |
| ~8 | C3" | M3" | Y3" | K3" |
| ~10 | C4" | M4" | Y4" | K4" |
| ~12 | C5" | M5" | Y5" | K5" |
| ~14 | C6" | M6" | Y6" | K6" |
| ~16 | C7" | M7" | Y7" | K7" |
| ~18 | C8" | M8" | Y8" | K8" |
| ~20 | C9" | M9" | Y9" | K9" |
| ~22 | C10" | M10" | Y10" | K10" |
| ~24 | C11" | M11" | Y11" | K11" |
| 24~ | C12" | M12" | Y12" | K12" |

FIG. 11

| Humidity 10-12 , Plain Paper (297mm or more) | | | | |
|---|---|---|---|---|
| Adhesion Power (kV) | Transfer Power | | | |
| | Cyan | Magenta | Yellow | Black |
| 0~0.4 | $C_1$ | $M_1$ | $Y_1$ | $K_1$ |
| ~0.6 | $C_2$ | $M_2$ | $Y_2$ | $K_2$ |
| ~0.8 | $C_3$ | $M_3$ | $Y_3$ | $K_3$ |
| ~1.0 | $C_4$ | $M_4$ | $Y_4$ | $K_4$ |
| ~1.2 | $C_5$ | $M_5$ | $Y_5$ | $K_5$ |
| ~1.4 | $C_6$ | $M_6$ | $Y_6$ | $K_6$ |
| ~1.6 | $C_7$ | $M_7$ | $Y_7$ | $K_7$ |
| ~1.8 | $C_8$ | $M_8$ | $Y_8$ | $K_8$ |
| ~2.0 | $C_9$ | $M_9$ | $Y_9$ | $K_9$ |
| ~2.2 | $C_{10}$ | $M_{10}$ | $Y_{10}$ | $K_{10}$ |
| ~2.4 | $C_{11}$ | $M_{11}$ | $Y_{11}$ | $K_{11}$ |
| 2.4~ | $C_{12}$ | $M_{12}$ | $Y_{12}$ | $K_{12}$ |

FIG. 12

| Humidity 10-12, Plain Paper (297mm or more) | | | | |
|---|---|---|---|---|
| Adhesion Power (kV) | Transfer Power | | | |
| | Cyan | Magenta | Yellow | Black |
| 0~0.4 | $C_1'$ | $M_1'$ | $Y_1'$ | $K_1'$ |
| ~0.6 | $C_2'$ | $M_2'$ | $Y_2'$ | $K_2'$ |
| ~0.8 | $C_3'$ | $M_3'$ | $Y_3'$ | $K_3'$ |
| ~1.0 | $C_4'$ | $M_4'$ | $Y_4'$ | $K_4'$ |
| ~1.2 | $C_5'$ | $M_5'$ | $Y_5'$ | $K_5'$ |
| ~1.4 | $C_6'$ | $M_6'$ | $Y_6'$ | $K_6'$ |
| ~1.6 | $C_7'$ | $M_7'$ | $Y_7'$ | $K_7'$ |
| ~1.8 | $C_8'$ | $M_8'$ | $Y_8'$ | $K_8'$ |
| ~2.0 | $C_9'$ | $M_9'$ | $Y_9'$ | $K_9'$ |
| ~2.2 | $C_{10}'$ | $M_{10}'$ | $Y_{10}'$ | $K_{10}'$ |
| ~2.4 | $C_{11}'$ | $M_{11}'$ | $Y_{11}'$ | $K_{11}'$ |
| 2.4~ | $C_{12}'$ | $M_{12}'$ | $Y_{12}'$ | $K_{12}'$ |

FIG. 13

| Humidity 10-12 , Plain Paper (297 mm or more) | | | | |
|---|---|---|---|---|
| Adhesion Power (kV) | Transfer Power | | | |
| | Cyan | Magenta | Yellow | Black |
| 0~0.4 | $C_1''$ | $M_1''$ | $Y_1''$ | $K_1''$ |
| ~0.6 | $C_2''$ | $M_2''$ | $Y_2''$ | $K_2''$ |
| ~0.8 | $C_3''$ | $M_3''$ | $Y_3''$ | $K_3''$ |
| ~1.0 | $C_4''$ | $M_4''$ | $Y_4''$ | $K_4''$ |
| ~1.2 | $C_5''$ | $M_5''$ | $Y_5''$ | $K_5''$ |
| ~1.4 | $C_6''$ | $M_6''$ | $Y_6''$ | $K_6''$ |
| ~1.6 | $C_7''$ | $M_7''$ | $Y_7''$ | $K_7''$ |
| ~1.8 | $C_8''$ | $M_8''$ | $Y_8''$ | $K_8''$ |
| ~2.0 | $C_9''$ | $M_9''$ | $Y_9''$ | $K_9''$ |
| ~2.2 | $C_{10}''$ | $M_{10}''$ | $Y_{10}''$ | $K_{10}''$ |
| ~2.4 | $C_{11}''$ | $M_{11}''$ | $Y_{11}''$ | $K_{11}''$ |
| 2.4~ | $C_{12}''$ | $M_{12}''$ | $Y_{12}''$ | $K_{12}''$ |

IMAGE FORMING APPARATUS

CROSS-REFERENCED APPLICATIONS

This application is based on Applications No. HEI 9-251808 and No. HEI 10-187416 filed in Japan, the content of which is hereby incorporated by reference.

BACKGROUND OF THE INVENTION

1. Field of the Invention

The present invention relates to an image forming apparatus of the tandem type for sequentially transferring a plurality of images to the same transfer medium, and specifically relates to an improvement of the art for controlling transfer output dependent on transfer timing.

2. Description of the Related Art

In recent years various types of color image forming apparatuses have been developed in response to demand for color copiers and color printers; an example of such an image forming apparatus is shown in FIG. 14.

FIG. 14 briefly shows the general construction of a tandem type image forming apparatus.

As shown in the drawing, the tandem type image forming apparatus provides at predetermined intervals photosensitive drums 401C–401K image processing units 400C–400K used for color image formation of cyan (C), magenta (M), yellow (Y), and black (K) arrayed from the upstream side in the sheet transport direction (hereinafter referred to simply as "upstream side") to the downstream side in the transport direction (hereinafter referred to simply as "downstream side") of transport belt 201 circumscribing a drive roller 202 and a driven roller 203 (hereinafter the reproduced colors of cyan (C), magenta (M), yellow (Y), and black (K) are represented simply by C, M, Y, and K, and the reference numbers of components related to said reproduced colors have the symbol C, M, Y, or K appended thereto).

Before being optically exposed by a light beam emitted from an optical scanning unit not shown in the drawing, the surfaces of photosensitive drums 401C–401K are uniformly charged by chargers 404C–404K after residual toner is removed from said surfaces by cleaners 402C–402K and residual charge is removed therefrom by exposure from eraser lamps 403C–403K, and when the uniformly charged surfaces are exposed by the aforesaid light beam, electrostatic latent images are formed on the respective surfaces of photosensitive drum 401C–401K. These electrostatic latent images are developed by toners of colors C–K supplied from developing devices 405C–405K, thereby forming C–K toner images on the surfaces of photosensitive drums 401C–401K, respectively.

On the other hand, before recording member S such as a paper sheet or OHP sheet is placed on transport belt 201, the residual charge remaining on transport belt 201 is discharged by dischargers 801 and 802, residual adhered toner is removed from the surface of said belt by belt cleaner 900 so as to maintain the surface in a clean state, then transfer sheet S is fed from sheet guide 901 to transport belt 201, and said transfer sheet S is adhered to transport belt 201 by a charge applied between driven roller 203 and opposing roller 501 at the adhere position of recording sheet adhere unit 500, and said transfer sheet S is then fed to the transfer positions of image processing units 400C–400K synchronously with the image forming operation of the aforesaid photosensitive drums 401C–401K. When the charge is imparted between photosensitive drums 401C–401K and the transfer rollers 406C–406K at the transfer position with the transfer sheet S in the aforesaid adhered state, the toner images C–K formed on photosensitive drums 401C–401K are sequentially transferred onto transfer sheet S so as to be superimposed one upon another thereon without transfer sheet S wrapping around said photosensitive drums 401C–401K. The transfer sheet S carrying the toner images is separated from the transport belt 201 via discharge from separation charger 701, and the toner particles on the surface of the transfer member are fused to the surface of the sheet via fixing device 902.

OBJECTS AND SUMMARY

In tandem type image forming apparatuses, the transfer sheet S is sequentially transported past the transfer position of each image processing unit 401C–400K, when the trailing edge of transfer sheet S in the transport direction (hereinafter referred to simply as "trailing edge") separates from the transfer position of the adjacent image processing unit on the upstream side, e.g., when the trailing edge of transfer sheet S separates from the transfer position of the upstream image processing unit 400C, the impedance between photosensitive drum 401M and transfer roller 406M is momentarily elevated, such that the charge accumulated in this separation area momentarily flows between the photosensitive drum 401M and transfer roller 406M of image processing unit 400M.

This impedance fluctuation is described in detail below with reference to the drawings. FIG. 5 shows the charge distribution at the transfer area in the normal state with no impedance fluctuation.

In this drawing, the C transfer area is designated the first transfer area, the M transfer area is designated the second transfer area, the Y transfer area is designated the third transfer area, and the K transfer area is omitted from the drawing. As shown in the drawing, when transfer sheet S is present at each transfer area, the transfer sheet S and surface of transport belt 201 receive a negative charge from the photosensitive drum above, and a positive charge from the transfer charger below. In the example of FIG. 14, photosensitive drums 401C–401K correspond to the photosensitive drum above, and transfer rollers 406C–406K correspond to the transfer charger below.

In the instance of constant voltage control, a voltage is supplied to each transfer area to effect transfer. That is, a charge of uniform amount is supplied to the transfer member in the transfer area.

FIG. 15 shows the situation when there are a plurality of transfer areas. In the drawing, four positive charge units are imparted from the transport belt side of the first transfer area. This charge induces a charge of four negative charge units from the transfer sheet Side via electrostatic induction. The positive charge on the transport belt side is supplied via the transfer roller, and the negative charge on the transfer sheet Side is actually the charged toner.

As shown in FIG. 15, when there are a plurality of transfer areas, it must be considered that each transfer area will impart the same number of charge unit from the transport belt side.

As described above, it may be supposed that four positive charge units are imparted in the first transfer area, and four positive charge units are also then imparted in the second and third transfer areas. As shown in FIG. 15, in the second transfer area an additional four charge units are added to the four charge units imparted to the transfer member in the first transfer, such that a total of eight charge units are imparted to the transfer member. In the third transfer area an additional four charge units are added to the total of eight charge units imparted to the transfer member in the second transfer, such that a total of 12 charge units are imparted to the transfer member.

Therefore, the accumulation of the charge imparted in the transfer areas in the direction of transfer member transport from the upstream side to the downstream side is a phenomenon referred to as "charge up."

The amount of toner transferred to the transfer member from the photosensitive drum in each transfer area is dependent on the effective transfer voltage (i.e., the effective transfer voltage equals the voltage applied to the transfer member minus the transfer member potential). Since the transfer member potential increased in conjunction with the amount of charge accumulated on the transfer member, the transfer member potential is higher in the second transfer area which has eight accumulated charge units than in the first transfer area which has four accumulated charge units. Therefore, in order to transfer an equal amount of toner in each transfer area, the effective transfer voltage must be equalized in each transfer area.

That is, since the transfer potential is higher in the second transfer area than in the first transfer area, the applied voltage must be increased toward the downstream side to equalize the effective voltage so as to impart the aforesaid predetermined amount of charge in the downstream, transfer areas (i.e., the second transfer area relative to the first transfer area).

The impedance fluctuation in the third transfer area when, for example, the transfer sheet S separates from the second transfer area is described below with reference to FIG. 16.

The present inventors discovered a phenomenon wherein the surface potential on the trailing edge of the transfer sheet S rapidly increased on the transport belt 201 side at the moment the sheet separates from the second transfer area. This rapid increase in surface potential is surmised to be caused by the concentration of the charge on the trailing edge of the transfer sheet S which maintains a greater charge than does the center region of the transfer sheet S.

As a result, for example, consider the movement of the charge between the second transfer area and the third transfer area in the direction of the third transfer area as indicated by the arrow in the drawing. The amount of charge to accumulate upstream in the third transfer area, i.e., the amount of charge present on the upstream side of the third transfer area in the drawing, is typically assumed to be eight charge units. On the other hand, the accumulated charge from the second transfer area is increased in the third transfer area (10 charge units indicated by diagonal shading in the example of the drawing) when the transfer sheet S separates from the second transfer area due to the movement of the charge on the trailing edge of the transfer sheet S side caused by the rapid elevation of the surface potential of the transfer sheet S on the transport belt 201 side.

This apparently means the charge imparted for transfer in the third transfer area is somewhat reduced despite the fact that an identical voltage is applied, with the result that the transfer current is reduced. That is, the impedance is increased by the separation of the transfer sheet S.

Returning now to FIG. 14, the impedance between photosensitive drum 401M and transfer roller 406M is more accurately described as the total impedance of the impedance of the combined transport belt 201, transfer sheet S and toner on the area sandwiched between photosensitive drum 401M and transfer roller 406M, and the impedance of the combined transfer belt 201, transfer sheet S and toner on the area sandwiched between photosensitive drum 401C and transfer roller 406C, but the main cause of impedance fluctuation is a pseudo-impedance determined from the transfer voltage and transfer current in the area sandwiched between the photosensitive drum 401M and transfer roller 406M; this is referred to hereinafter simply as "impedance between the photosensitive drum and transfer roller." When transfer voltage is held constant as the impedance is elevated as described above, the transfer current in the aforesaid area becomes momentarily too small, so as to produce incomplete transfer of a number of toner particles in a direction perpendicular to the direction of travel of the transfer sheet S.

The transfer voltage and transfer current combined are referred to as "transfer output" hereinafter.

When the leading edge of the transfer sheet S in the transport direction (hereinafter referred to simply as "leading edge") is enters the transfer position of the adjacent downstream image processing unit, e.g., when the leading edge of transfer sheet S enters the transfer position of image processing unit 400Y, there is a change of the dielectric constant between photosensitive drum 401Y and transfer roller 406Y of image processing unit 400Y, which momentarily reduces the impedance between photosensitive drum 401M and transfer roller 406M of image processing unit 400M due to the momentary flow of the accumulated charge at the transfer position of image processing unit 400M to the entering portion.

This drop in impedance is discussed below with reference to FIG. 16(*b*).

Consider that the moment transfer sheet S enters the third transfer area, the surface potential of transport belt 201 is rapidly reduced on the transfer sheet S side at the leading edge of transfer sheet S, and the charge between the second transfer area and the third transfer area moves toward the third transfer area as indicated by the arrow in the drawing. The reason for the charge movement is thought to be the possible movement of charge between the photosensitive drum and transfer roller at the leading edge of the transfer sheet S, and the easy movement of charge from the leading edge of transfer sheet S.

When the typical charge accumulated upstream in the second transfer area is designated four charge units, the charge accumulated becomes the two charge units (diagonally shaded in FIG. 16(*b*)) due to the aforesaid charge movement. As a result, the charge imparted in the second transfer area becomes six charge units (indicated by the thick lines in FIG. 16(*b*)). This apparently means that there is an increase in the charge imparted in the transfer area when the sheet enters a downstream transfer area even though an identical voltage is applied, thereby increasing the transfer current. That is, the impedance is reduced.

When the impedance is reduce din this way and the transfer voltage remains constant, there is momentary excess transfer current in said transfer area, which produces excessive transfer of several toner particles in a direction perpendicular to the direction of travel of the transfer sheet S so as to excessively increase the density of an image having an overall uniform density, which leads to airborne dispersion of toner to other areas which in turn produces incomplete transfer similar to that occurring when the transfer current is too small.

The impedance fluctuation between photosensitive drum 401M and transfer roller 406M is very pronounced when the resistance value of transfer sheet S is reduced due to moisture absorption by transfer sheet S (less than $10^{10}$ Ω/m2), and impedance also fluctuates between photosensitive drums and the transfer rollers of image processing units 400C, 400Y, and 400K the moment the trailing edge of transfer sheet S separates from the transfer position of the adjacent upstream image processing unit, and when the leading edge of transfer sheet S enters the transfer area of the adjacent downstream image processing unit.

Although increasing the mutual spacing between the transfer positions of the respective image processing units 400C–400K so as to be greater than the length of the transfer sheet S has been considered to avoid the aforesaid situation, such a solution creates another disadvantage in that it increases the size if the apparatus.

An object of the present invention is to provide an image forming apparatus capable of producing excellent images without transfer irregularities regardless of impedance fluctuation dependent on transfer timing, and which avoids enlargement of the apparatus.

The aforesaid objects are attained by the image forming apparatus of the present invention which sequentially transfers toner images formed by a plurality of image forming units onto the same transfer sheet via a plurality of transfer charging means, wherein transfer output is controlled in accordance with the change of impedance of the transfer area dependent on the timing of each transfer.

In the image forming apparatus of the present invention, an impedance sensor is provided upstream of an image forming unit farthest upstream among a plurality of image forming units so as to detect fluctuation of the combined impedance of the transfer member and transport belt when transporting a transfer sheet.

The image forming apparatus of the present invention is provided with at least one among a detection means for detecting humidity and an input means for entering paper type, so as to control transfer output to correspond to a change in impedance based on at least one among humidity detected by said detection means and paper type entered via said entering means.

BRIEF DESCRIPTION OF THE DRAWINGS

These and other objects and features of the present invention will become apparent from the following description of the preferred embodiments thereof taken in conjunction with the accompanying drawings, in which:

FIG. 8 shows an example of the content of a regular transfer voltage setting table used in another embodiment of the present invention;

FIG. 9 shows an example of the content of a transfer voltage setting table when separating from an adjacent transfer area used in said other embodiment of the present invention;

FIG. 10 shows an example of the content of a normal transfer voltage setting table when entering an adjacent transfer area used in said other embodiment of the present invention;

FIG. 11 shows an example of part of the content of a regular transfer voltage setting table used in yet another embodiment of the present invention;

FIG. 12 shows an example of the content of a transfer voltage setting table when separating from an adjacent transfer area used in said other embodiment of the present invention;

FIG. 13 shows an example of part of the content of a normal transfer voltage setting table when entering an adjacent transfer area used in said other embodiment of the present invention;

FIG. 16(*b*) shows the change in impedance of an upstream transfer area when a transfer sheet enters a downstream transfer area.

In the following description, like parts are designated by like reference numbers throughout the several drawings.

DETAILED DESCRIPTION OF THE PREFERRED EMBODIMENTS

The image forming apparatus of the present invention is described hereinafter in terms of the preferred embodiments adapted to a tandem type image forming apparatus (hereinafter referred to simply as "image forming apparatus").

First Embodiment (1) General Construction of the Image Forming Apparatus

Figure 1:
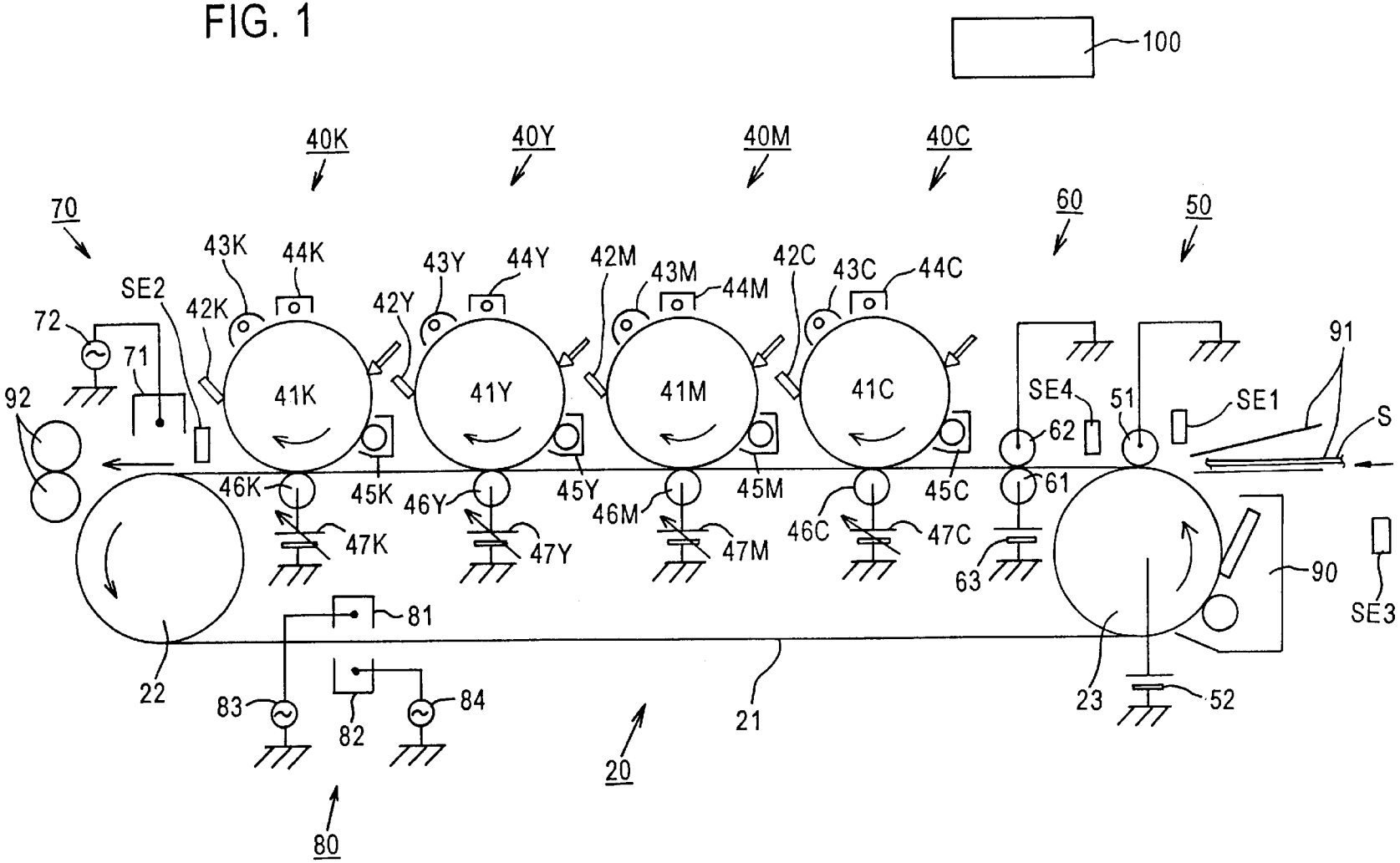
FIG. 1 shows the general construction of the image forming apparatus of the present invention.

FIG. 1 shows the general construction of an image forming apparatus of a first embodiment of the present invention.

The image forming apparatus in the drawing utilizes a well-known image forming process of the electrophotographic type to accomplish image formation, and is provided with a recording sheet transporting unit comprising a tensioned transport belt 21, and image processing units 40C–40K used to form images of each color C–K arranged at predetermined intervals from the upstream side to the downstream side above transport belt 21.

Recording sheet transporting unit 21 comprises an endless sheet transporting belt 21, drive roller 22 and driven roller 23 around which is arranged the sheet transporting belt 21; such that a transfer sheet S such as a paper sheet or OHP sheet or the like is transported at uniform speed on said transport belt 21 via the rotation of drive roller 22 provided by a motor not shown in the drawing. Transport belt 21 is formed of a material having a high dielectric constant such as, for example, polyvinylidene fluoride (PVDF) at a width equal to that of the drive roller 22 and driven roller 23 and a thickness of 150 $\mu$m.

Image processing units 40C–40K comprise a core of photosensitive drums 41C–41K, and disposed around the periphery of said photosensitive drums 41C–41K are cleaners 42C–42K, eraser lamps 43C–43K, chargers 44C–44K, developing devices 45C–45K, transfer rollers 46C–46K formed of conductive material and arranged so as to sandwich transport belt 21 between said transfer rollers and the lowermost position of photosensitive drums 41C–41K, and transfer voltage power sources 47C–47K of a constant voltage type for supplying a high direct current voltage to said transfer rollers 46C–46K, such that a transported transfer sheet S and transport belt 21 are pressed between photosensitive drums 41C–41K and transfer rollers 46C–46K so as to transfer a charged toner image to said transfer sheet S between said drum and said transfer roller in the transfer area. The aforesaid constant voltage transfer is a method wherein a constant voltage is regularly supplied to an electrode in the transfer area.

Located on the periphery of the path of transport belt 21 are recording sheet adhesion unit 50 for electrostatically adhering transfer sheet S to transport belt 21, impedance detector 60 for detecting change in impedance of transfer sheet S, recording sheet separation unit 70 for separating the electrostatically adhered transfer sheet S from transport belt 21, discharge unit 80 for discharging the charge of transport belt 21, and cleaner 90 for eliminating residual toner from the surface of transport belt 21.

Recording sheet adhesion unit 50 comprises a driven roller 23, adhesion roller pair 51 arranged directly above driven roller 23 so as to grip transport belt 21 therebetween, and adhesion high voltage power source 52 of a constant current type for supplying a high DC voltage to driven roller 23 at a predetermined constant current (e.g., 6 $\mu$A). Driven roller 23 and adhesion roller pair 51 are formed of a conductive material such as aluminum, said adhesion roller pair 51 being grounded, and a transfer sheet S transported along sheet guide 91 and a transport belt 21 are pressed between driven roller 23 and adhesion roller pair 51, and transfer sheet S receives a charge between said roller pair and transport belt 21 internal charge are polarized so as to electrostatically adhere said transfer sheet to transport belt 21. The fluctuation of impedance between both said rollers can be detected from the voltage and current flowing between both said rollers.

Impedance detector 60 comprises a pair of rollers 61 and 62 disposed opposite one another so as to grip transport belt 21 therebetween, and an impedance detection high voltage source 63 for supplying a high DC voltage to said roller 61 at a predetermined constant current (e.g., 6 $\mu$A). Rollers 61 and 62 are formed of conductive material such as aluminum, said roller 62 being grounded, and a transfer sheet S transported and adhered to transport belt 21 is pressed between said rollers 61 and 62, and the fluctuation of impedance between both said rollers can be detected from the voltage and current flowing between both said rollers.

Recording sheet separation unit 70 is provided with a drive roller 22, discharger 71 disposed above drive roller 22 so as to grip transport belt 21 therebetween, and sheet separation power source 72 for supplying an AC voltage to discharger 71, so as to separate an electrostatically adhered transfer sheet S from transport belt 21.

Discharge unit 80 is provided with a pair of dischargers 81 and 82 disposed opposite one another so as to grip transport belt 21 therebetween, and discharge power sources 83 and 84 for supplying AC voltages to said dischargers 81 and 82, so as to discharge a charge accumulated on transport belt 21.

On the upstream side of sheet transport unit 20 are provided a paper cassette (not illustrated) for accommodating a plurality of stacked transfer sheets S of a predetermined size, take-up roller (not illustrated) for feeding said transfer sheet S from said cassette, and registration roller (not illustrated) for timing the feeding of transfer sheet S to transport belt 21 via sheet guide 91, and a fixing device 92 is provided on the downstream side of sheet transport unit 20.

Directly in front of sheet adhesion unit 50 on the upstream side is provided a sheet sensor SE4 for detecting transfer sheet S, and directly in front of sheet separation unit 70 on the upstream side is provided a sheet sensor SE2. Near the aforesaid paper cassette is provided an environment sensor SE3 for detecting environmental information such as temperature and humidity near said paper cassette, and directly in front of cassette 91 on the upstream side is provided a sheet size sensor SE4 for detecting the size of transfer sheet S (i.e., dimension in the sheet transport direction and dimension in the direction perpendicular thereto).

Residual toner is removed from the surface of photosensitive drums 41C–41K via cleaners 42C–42K, and residual charge is removed from said drum surface via exposure by eraser lamps 43C–43K, and the drum surface is thereafter uniformly charged by chargers 44C–44K before exposure by a light beam emitted from an optical scanning unit not shown in the drawing, so as to form an electrostatic latent image on the surface of photosensitive drums 41C–41K. Each electrostatic latent image is developed by toner supplied from developing devices 45C–45K, so as to form C–K toner images on the surfaces of photosensitive drums 41C–41K.

On the other hand, the residual toner adhering to the surface of transport belt 21 is removed by belt cleaner 90, and the residual charge is removed therefrom by dischargers 81 and 82 so as to maintain the surface of the belt in a clean state before receiving transfer sheet S, then is fed from cassette 91 to transport belt 21 and adhered thereto by a charge imparted between driven roller 23 and adhesion roller pair 51 at the adhesion position of sheet adhesion unit 50, then the transfer sheet S is transported to the transfer position of image processing units 40C–40K synchronously with the image forming operations of the aforesaid photosensitive drums 41C–41K. When a charge is imparted between photosensitive drums 41C–41K and the transfer rollers 46C–46K at the transfer position in the aforesaid adhered state, the transfer sheet S is wrapped around said photosensitive drum 41C–41K and each C–K toner image formed on the photosensitive drums 41C–41K is sequentially transferred to the transfer sheet S such that the toner images are superimposed one upon another on sheet S in a sequential overlay transfer. The transfer sheet S carrying the transferred toner images is transported to separation charger 71 and separated from transport belt 21, and the toner particles on the surface of transfer sheet S are fused to the surface of said sheet S by fixing device 92.

(2) Construction of Controller 100 and vicinity

Figure 2:
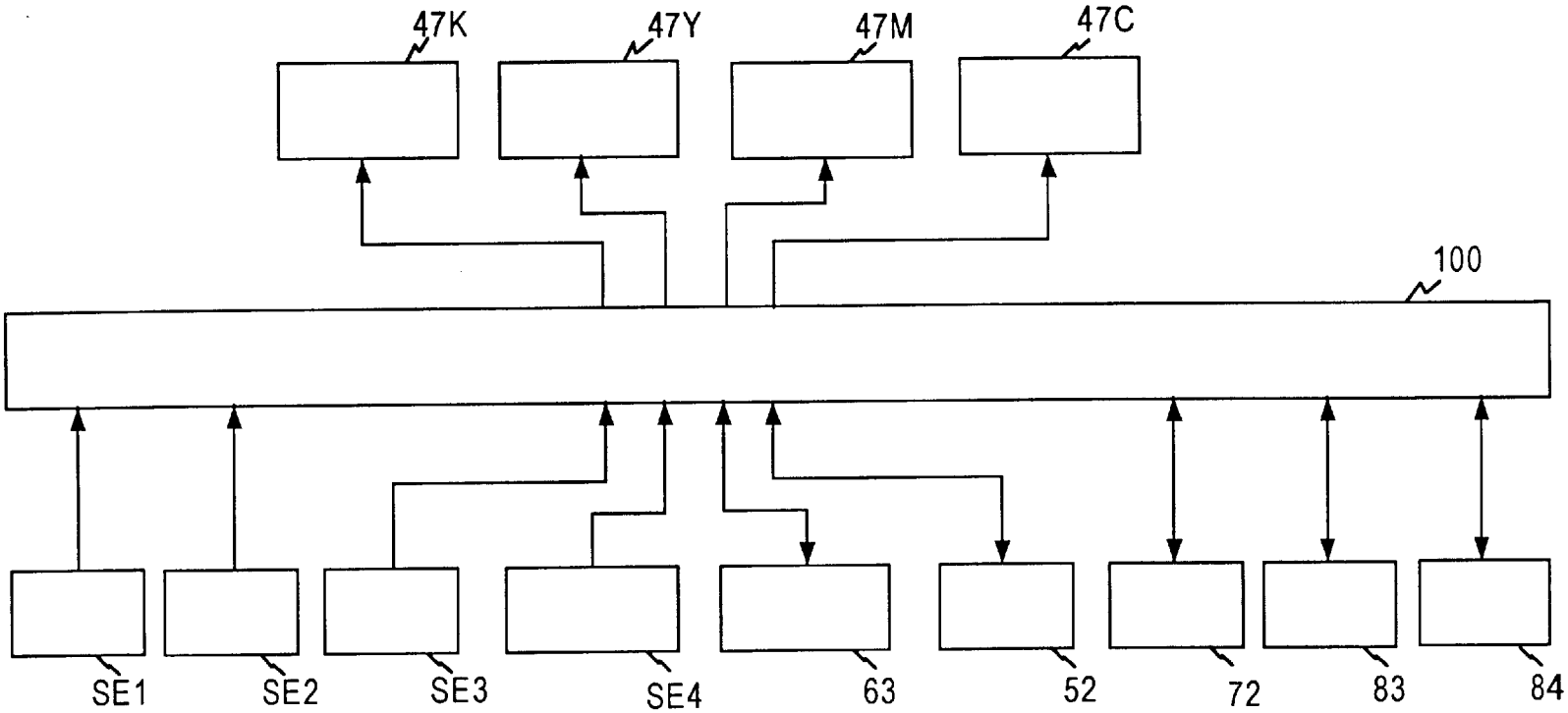
FIG. 2 is a block diagram showing the construction of controller 100 and its vicinity within the image forming apparatus.

FIG. 2 is a block diagram showing the construction of controller 100 and vicinity provided within the image forming apparatus.

As shown in the drawing, controller 100 is provided with a CPU, RAM, and ROM and timers not illustrated within the apparatus, and controller 100 is connected to sheet position sensors SE1 and SE2, environment sensor SE3, sheet size sensor SE4, adhesion high voltage power source 52, impedance detection high voltage power source 63, sheet separation power source 72, discharge power sources 83 and 84, and transfer high voltage power sources 47C–47K.

The CPU of controller 100 executes programs stored in ROM for controlling voltage output from transfer high voltage power sources 47C–47K, and uniformly controls the timing of the transfer operations based on detection output from the various sensors and read output such as control data and the like, so as to smoothly execute the copy operation.

More specifically, when the sheet sensor SE1 detects the arrival of the leading edge of transfer sheet S at sheet adhesion unit 50, the CPU receives a detection signal therefrom and begins timing while executing adhesion via sheet adhesion unit 50, then transfer sheet S is fed toward transport belt 21, and jamming of sheet S is detected by sheet sensor SE2.

When the CPU receives the sheet size information detected by size sensor SE4, and detects whether or not sheet S is present on transport belt 21, the CPU executes timing to start output of the transfer current/transfer voltage between photosensitive drums 41C–41K and transfer rollers 46C–46K by starting the timers using the detection of the leading edge of sheet S as a standard, and to start output of transfer current/transfer voltage between photosensitive drums 41C–41K and transfer rollers 46C–46K when the sheet S enters the next adjacent transfer area on the downstream side. Furthermore, the CPU controls timing to start output of the transfer current/transfer voltage between photosensitive drums 41C–41K and transfer rollers 46C–46K when the sheet S separates from the adjacent transfer area on the upstream side by starting timers using detection of the leading edge of sheet S as a standard, and to end output of transfer current/transfer voltage between photosensitive drums 41C–41K and transfer rollers 46C–46K.

The CPU sends instructions to transfer area high voltage power sources 47C–47K in accordance with the aforesaid timing based on environment data such a temperature and humidity n the vicinity of the paper cassette detected by environment sensor SE3, voltage change data between driven roller 23 and adhesion roller pair 51 detected at the adhesion position of adhesion unit 50, and voltage change data between rollers 61 and 62 detected at the impedance detection position by impedance detection unit 60, so as to control the transfer voltage between photosensitive drums 41C–41K and transfer rollers 46C–46K supplied from said transfer high voltage power sources 47C–47K.

(3) Transfer Output Control Operation

The controls executed by the CPU of controller 100 are described below when making A4 size plain paper copies (weight: 80 g/m2) in portrait orientation after storage for 24 hr under specific conditions of 23° C. and 85% humidity.

First, the impedance detection of sheet adhesion unit 50 and impedance detection unit 60 during transport of transfer sheet S is described below.

Figure 3:
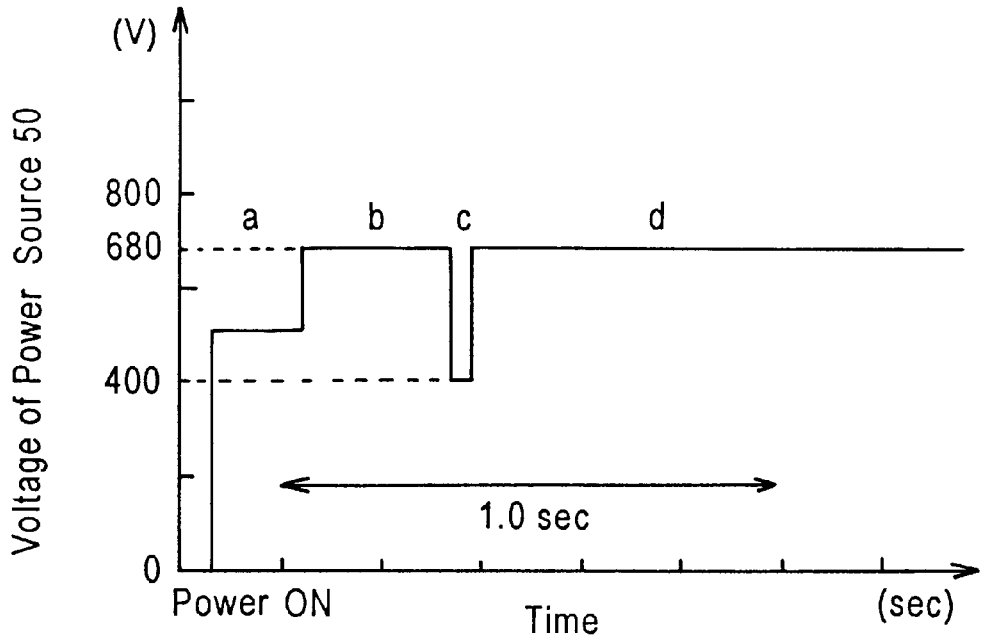
FIG. 3 shows the voltage change between driven roller 23 and pressure roller pair 51 of recording sheet adhesion unit 50.

FIG. 3 shows the voltage change between driven roller 23 and adhesion roller pair 51 of sheet adhesion unit 50.

The transport belt 21 and transfer sheet S pass between the drive roller 23 and adhesion roller pair 51 at constant speed, and during said passage a constant current of 6 $\mu$A is applied between driven roller 23 and adhesion roller pair 51 from the adhesion high voltage power source 52.

As shown in the drawing, the voltage between driven roller 23 and adhesion roller pair 51 is virtually constant at 680 V at region b after the leading edge of transfer sheet S passes the adhesion position of sheet adhesion unit 50 until it enters the impedance detection position of impedance detection unit 60, and region d after the leading edge of transfer sheet S enters the impedance detection position of impedance detection unit 60. The impedance between the driven roller 23 and the adhesion roller pair 51 at this time is about 113.3 MΩ.

Conversely, the voltage between the driven roller 23 and adhesion roller pair 51 drops momentarily to about 400 V at region c when the leading edge of transfer sheet S enters the impedance detection position of impedance detection unit 60. This drop in impedance between driven roller 23 and adhesion roller pair 51 is due to the change in the dielectric constant at the impedance detection position which produces an inflow of the charge accumulated on the transfer sheet S to the roller 62 of impedance detection unit 60 at the moment the leading edge of transfer sheet S enters the impedance detection position of impedance detection unit 60. The impedance between driven roller 23 and adhesion roller pair 51 at this time is about 66.7 MΩ.

Figure 4:
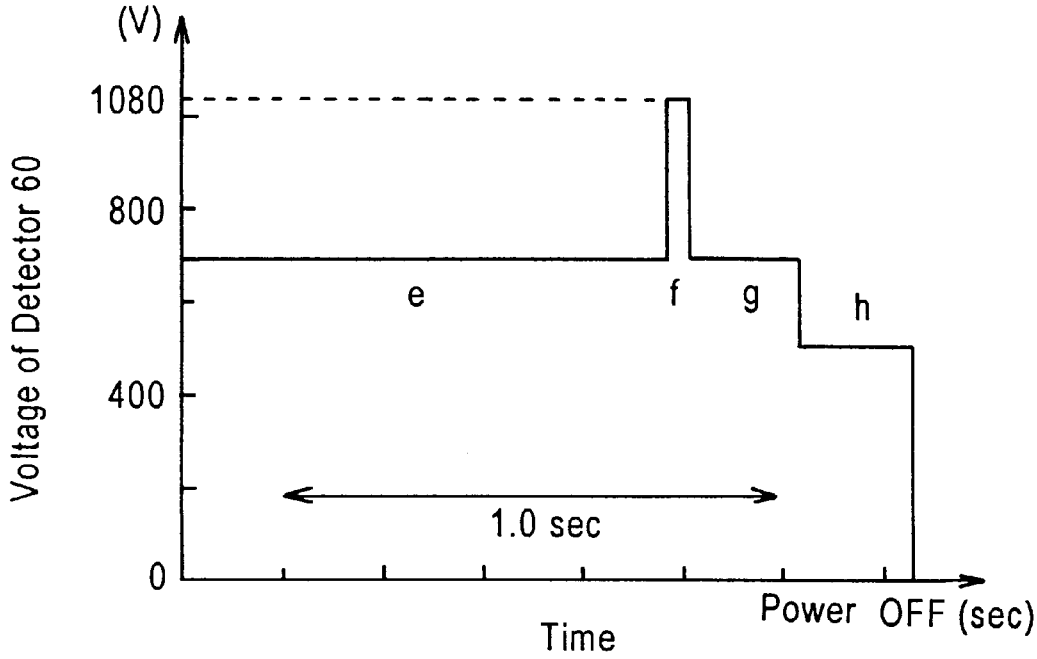
FIG. 4 shows the voltage change between rollers 61 and 62 of impedance detector 60.

FIG. 4 shows the voltage change between rollers 61 and 62 of the impedance detection unit 60.

Transport belt 21 and transfer sheet S pass between rollers 61 and 62, and during said passage a constant current of 6 $\mu$A is supplied to sheet adhesion unit 50 between both rollers 61 and 62 from impedance detection high voltage power source 63.

As shown in the drawing, the voltage between rollers 61 and 62 is virtually constant at 700 V at region e after the leading edge of transfer sheet S passes the impedance detection position of impedance detection unit 60 until before the trailing edge of sheet S separates from the adhesion position of sheet adhesion unit 50, and region g after the trailing edge of sheet S has separated from the adhesion position of adhesion unit 50. The impedance between rollers 61 and 62 at this time is about 116.7 MΩ.

Conversely, the voltage between rollers 61 and 62 is momentarily elevated to about 1080 V at region f when the trailing edge of transfer sheet S separates from the adhesion position of adhesion unit 50. This elevation in impedance between rollers 61 and 62 is due to the change in the dielectric constant at the adhesion position which produces an inflow of the charge accumulated on the transfer sheet S at the adhesion position of adhesion unit 50 to the roller 62 of impedance detection unit 60 at the moment the trailing edge of transfer sheet S separates from the adhesion position of adhesion unit 50. The impedance between rollers 61 and 62 at this time is about 180 MΩ.

The impedance is similarly elevated when the trailing edge of sheet S separates from the transfer position of the adjacent upstream image processing units 40Y–40K between photosensitive drums 41M–41K and transfer rollers 46M–46K and of each image processing unit 40M–40K, and the impedance similarly drops when the leading edge of sheet S enters the transfer area of the adjacent downstream image processing unit 40C–40Y even between photosensitive drums 41C–41Y and transfer rollers 46C–46Y of image processing units 40C–40Y.

Accordingly, when a constant transfer voltage is supplied between photosensitive drums 41C–41K and transfer rollers 46C–46K from the transfer high voltage power sources 47C–47K, the transfer current becomes excessively small and excessively large in the area of impedance fluctuation as previously shown.

The CPU of controller 100 feeds back the impedance fluctuation detected in sheet adhesion unit 50 and impedance detection unit 60 to the voltage control of transfer high voltage power sources 47C–47K so as to reduce the transfer voltage between photosensitive drums 41C–41K and transfer rollers 46C–46K when the transfer current becomes too large with the timing of the rise in impedance when the trailing edge of sheet S separates from the upstream transfer position, and increase the transfer voltage between photosensitive drums 41C–41K and transfer rollers 46C–46K when the transfer current becomes too small with the timing of the drop in impedance when the leading edge of the sheet S enters the downstream transfer position.

Specifically, in the aforesaid transfer output control, a transfer voltage V0 is determined at regions b and d (refer to FIG. 3) at which the impedance does not change. In the present embodiment, separate calculation method is used in accordance with the size of sheet S in the horizontal direction (width d in the direction perpendicular to the transport direction) when controlling the transfer voltage. That is, a different calculation method is used when the size of sheet S in the horizontal direction is 297 mm or greater than when the size is less than 297 mm. Since impedance detecting unit 60 detects the impedance of the combined sheet and non-sheet area when the transfer sheet S is small, this calculation is converted to the impedance of the sheet area.

First, the transfer voltage V0 is calculated as shown below when the sheet size in the transport direction is 297 mm or greater (Eq. 1).

$$V0=C1\cdot(Vb/6)\cdot It+VDB \quad \text{[Equation 1]}$$

Where V0 is a set voltage value (V) when impedance is constant, and C1 is a correction constant (unit-less) over the transfer sequence.

As previously described, the transfer voltage must be raised after transfer to produce the same transfer current due to the impedance generated by the increase in charge on transfer sheet S and transport belt 21 when performing overlay transfers. In the present embodiment, the coefficient of this increment is determined beforehand by past data. Specifically, this coefficient is set at C:1.05, M:1.10, Y:1.15, K:1.20. These values are identical in the following description.

The value Vb is the voltage value (V) of adhesion high voltage power source 52 in area b of FIG. 3. The value 6 of (Vb/6) represents the current value 6 ($\mu$A) acting in adhesion unit 50. Therefore, (Vb/6) expresses the impedance (MΩ) of transfer sheet S plus transport belt 21.

The value It is the suitable transfer current ($\mu$A) when transfer sheet S is 297 mm or greater in the transport direction. Since the suitable transfer current is dependent on the environment, and particularly humidity), the value of It is set via a prepared table for each absolute humidity. Specifically, the value It is selected based on the absolute humidity detected by environment sensor SE3.

The value VDB is the set current value (V) of the developing bias.

The transfer voltage setting is set using the potential of the photosensitive drum as a standard, such that the transfer voltage is calculated by adding a set voltage VDB of the developing bias equal to the potential of the photosensitive member directly before transfer.

As a specific example of the present embodiment, if the value Vb is 680 V from the measured voltage of adhesion power source 52, the suitable transfer current It selected from the absolute humidity detected by sensor SE3 is 12 $\mu$A, and the developing bias set voltage VDB is −450 V it can be determined from Equation 1 that the transfer voltage V0 is 978 V between photosensitive drum 41C and transfer roller 46C, 1046 V between photosensitive drum 41M and transfer roller 46M, 1114 V between photosensitive drum 41Y and transfer roller 46Y, and 1182 V between photosensitive drum 41K and transfer roller 46K.

On the other hand, when the size of transfer sheet S in the transport direction is less than 297 mm, the transfer voltage V0 is calculated using Equation 2 below.

$$V0=\frac{(1-C2)\cdot Va\cdot Vb}{6\cdot\{(1-C2)\cdot Va-Vb\}}\cdot It\cdot C2+VDB \quad \text{[Equation 2]}$$

Where C2 is a correction constant corresponding to the size of transfer sheet S in the transport direction.

Specifically, the ratio of the size of transfer sheet S relative to an A4 portrait size sheet (297 mm) is used. For example, when an A4 size sheet in the portrait orientation passes, the value C2 becomes 210/297 =0.71. this value is set beforehand based on the size of transfer sheet S.

The value Va is the voltage (V) of adhesion power source 52 where there is no transfer sheet S (i.e., belt 21 only) (part a of FIG. 3). The value 6, which is in the denominator of the fractional part of the first half of the equation, represents the current supplied to adhesion unit 50 (i.e., 6 $\mu$A). Therefore, the totality of the fraction of the left side of the equation expresses the impedance between the rollers at the part where transfer sheet S is present. When the transfer sheet S is small and the value Va is used, there is an area between the rollers where sheet S is not present, and since the impedance combines the area of detected sheet S and non-sheet S, the impedance of the area without sheet S must be used even when calculating the impedance of the are with transfer sheet S.

Other content is identical to that described with reference to Equation 1.

Then, the transfer voltage VL is determined at region c (refer to FIG. 3) where the impedance drops when the leading edge of transfer sheet S enters the downstream transfer area. Transfer voltage VL is calculated by Equation 3 below when the size of transfer sheet S in the transport direction is 297 mm or greater.

$$VL=\{C1\cdot(Vb/6)\cdot It=C1\cdot(Vc/6)\cdot It\}/2=VDB \quad \text{[Equation 3]}$$

Where VL is the set voltage (V) when impedance drops, and Vc is the voltage (V) of adhesion power source 52 in area c of FIG. 3.

$$C1\cdot(Vb/6)\cdot It \quad \text{[Equation 4]}$$

In part of Equation 4, the number 6 represents the current 6 $\mu$A applied by adhesion unit 50. Therefore, the totality of Equation 4 expresses a suitable voltage for the transfer area when impedance is constant. The potential of the photosensitive drum is not considered.

$$C1\cdot(Vc/6)\cdot It \quad \text{[Equation 5]}$$

In part of Equation 5, the number 6 represents the current 6 $\mu$A applied by adhesion unit 50. Therefore, the totality of Equation 5 expresses a suitable voltage for the transfer area when impedance drops. The potential of the photosensitive drum is not considered.

The developing bias set voltage VDB is not simply added to the value of Equation 5 as the set voltage VL when impedance drops, inasmuch as consideration is given to delays for power source responsiveness, control timing and the like, such that a transfer voltage to achieve excellent transfer must be set in the transfer areas of both impedance drops and normal impedance before and after an impedance drop. For example, when the voltage change timing and impedance drop timing shift, the transfer voltage is reduced causing incomplete transfer when the value of Equation 5 is added to VDB regardless of whether or not the impedance is uniform.

Therefore, to avoid incomplete transfer, the transfer voltage is set to less than perfect transfer efficiency but not to a degree that is noticeable for both normal impedance and reduced impedance, by setting the voltage at the average of Equation 4 and equation 5, and adding VDB to this averaged value. When the sheet transport speed is increased, there is a short period of reduced impedance, and since the timing of the impedance drop becomes difficult when the voltage changes, high precision transport speed detection is required, but this can be omitted from the method of the present embodiment.

As a specific example of the present embodiment, if the value Vb is 680 V from the measured voltage of adhesion power source 52, the value Vc is 400 V from the measured voltage of adhesion power source 52 at area c of FIG. 3, the suitable transfer current It selected from the absolute humidity detected by sensor SE3 is 12 μA, and the developing bias set voltage VDB is −450 V, it can be determined from Equation 3 that the transfer voltage VL is 684 V between photosensitive drum 41C and transfer roller 46C, 738 V between photosensitive drum 41M and transfer roller 46M, and 792 V between photosensitive drum 41Y and transfer roller 46Y. Since there is no image processing unit downstream from image processing unit 40K, there is no impedance drop at image processing unit 40K, and therefore this control is not executed.

On the other hand, when the size of transfer sheet S in the transport direction is less than 297 mm, the transfer voltage V0 is calculated using Equation 6 below.

$$VL = C1\left[\frac{(1-C2)\cdot Va\cdot Vb}{6\cdot\{(1-C2)\cdot Va - Vb\}}\cdot It\cdot C2 + \frac{(1-C2)\cdot Va\cdot Vc}{6\cdot\{(1-C2)\cdot Va - Vc\}}\cdot It\cdot C2\right]\Big/2 + VDB \quad \text{[Equation 6]}$$

where $$C1\cdot\frac{(1-C2)\cdot Va\cdot Vb}{6\cdot\{(1-C2)\cdot Va - Vb\}}It\cdot C2 \quad \text{[Equation 7]}$$

In part of Equation 7, the number 6 represents the current 6 μA applied by adhesion unit 50. Therefore, the part expressed in this fraction is the impedance between rollers when a transfer sheet S is present, and the totality of Equation 7 expresses a suitable voltage for the transfer area when impedance is constant. The potential of the photosensitive drum is not considered.

$$C1\cdot\frac{(1-C2)\cdot Va\cdot Vc}{6\cdot\{(1-C2)\cdot Va - Vc\}}It\cdot C2 \quad \text{[Equation 8]}$$

In part of Equation 8, the number 6 represents the current 6 μA applied by adhesion unit 50. Therefore, the part represented by the fraction is the impedance between rollers when a transfer sheet S is present, and the totality of Equation 8 expresses a suitable voltage for the transfer area when impedance drops. The potential of the photosensitive drum is not considered.

The reason the value VDB represented in Equation 8 is not added to the transfer voltage when impedance drops is identical to the reason given in Equation 1.

Other content is identical to Equation 3.

Next, the transfer voltage VH is determined in the region (region f of FIG. 4) of impedance rise when the trailing edge of transfer sheet S separates from the upstream transfer area. The transfer voltage VH is calculated by Equation 9 below when the size of transfer sheet S in the transport direction is 297 mm or greater.

$$VH=\{C1\cdot(Vb/6)\cdot It+C1\cdot(Vf/6)\cdot It/1.025\}/2+VDB \quad \text{[Equation 9]}$$

Where VH is the set voltage V during impedance rise, and Vf is the voltage (V) of impedance detection unit 60 in area f of FIG. 4.

$$C1\cdot(Vf/6)\cdot It/1.025 \quad \text{[Equation 10]}$$

In part of Equation 10, the number 6 specifies the current 6 μA applied by adhesion unit 50, and the totality of Equation 10 expresses a suitable voltage for the transfer area when impedance rises. The potential of the photosensitive drum is not considered. In this instance, the division by 1.025 is in consideration of the charge rise at adhesion unit 50.

The reason VDB is not simply added to Equation 10 as the set voltage for impedance rise is in consideration of the margin of set voltage fluctuation.

As a specific example of the present embodiment, if the value vb is 680 V from the measured voltage of adhesion power source 52, the value Vf is 1080 V from the measured voltage of adhesion power source 52 at area f of FIG. 4, the suitable transfer current It selected from the absolute humidity detected by sensor SE3 is 12 μA, and the developing bias set voltage VDB is −450 V, it can be determined from Equation 6 that the transfer voltage VH is 1370 V between photosensitive drum 41C and transfer roller 46C, 1457 V between photosensitive drum 41M and transfer roller 46M, 1544 V between photosensitive drum 41Y and transfer roller 46Y, and 1630 between photosensitive drum 41K and transfer roller 46K.

Since the impedance detection unit 60 is present and there is no image processing unit upstream from image processing unit 40C, the conditions are slightly different that for the other image processing units 40M–40K; Equation 9 is used for the same calculation since the change in impedance is almost identical.

On the other hand, when the size of transfer sheet S in the transport direction is less than 297 mm, the transfer voltage VH is calculated using Equation 11 below.

$$VH = C1\left[\frac{(1-C2)\cdot Va\cdot Vb}{6\cdot\{(1-C2)\cdot Va - Vb\}}\cdot It\cdot C2 + \frac{(1-C2)\cdot Vh\cdot Vf}{6\cdot\{(1-C2)\cdot Vh - Vf\}}\cdot It\cdot C2/1.025\right]\Big/2 + VDB \quad \text{[Equation 11]}$$

Where Vh represents the voltage V of impedance detection unit 60 in the area without transfer sheet S (belt only) (area h in FIG. 4.

The reason Vh is used to calculate impedance is identical in content to the reason given for using Va above.

$$C1\cdot\frac{(1-C2)\cdot Vh\cdot Vf}{6\cdot\{(1-C2)\cdot Vh - Vf}\cdot It\cdot C2/1.025 \quad \text{[Equation 12]}$$

In part of Equation 12, the number 6 specifies the current 6 μA applied by adhesion unit 50. Therefore, the part represented by the fraction is the impedance between the rollers when transfer sheet S is present, and the totality of Equation 12 expresses a suitable voltage for the transfer area when impedance rises. The potential of the photosensitive drum is not considered.

The reason VDB is not simply added to Equation 12 as the transfer voltage for impedance rise is given above.

Figure 5:
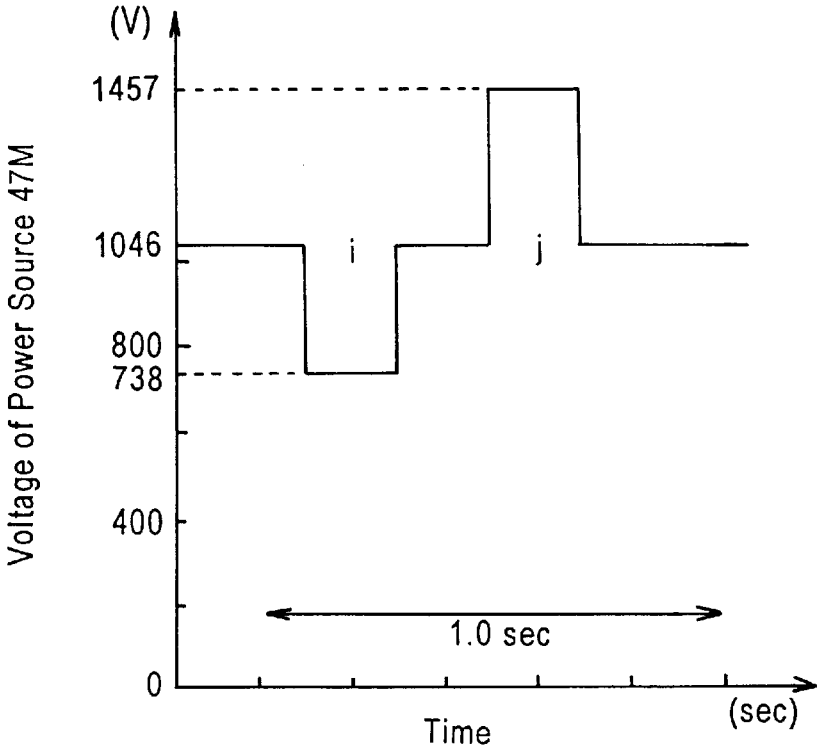
FIG. 5 shows the transfer voltage control between transfer roller 46M and photosensitive drum 41M of image processing unit 40M.

FIG. 5 shows the controls of the transfer voltage between photosensitive drum 41M and transfer roller 46M of image processing unit 40M determined by Equations 1–12 above. When the trailing edge of transfer sheet S separates from the transfer position of the upstream image processing unit 40C and when the leading edge of transfer sheet S enters the transfer position of the downstream image processing unit 40Y, the voltage changes ±0.2 sec from the center of the sheet S separation timing and entrance timing in consideration of the responsiveness of transfer voltage source 47M and variation of sheet feeding timing (regions i, j).

Figure 6:
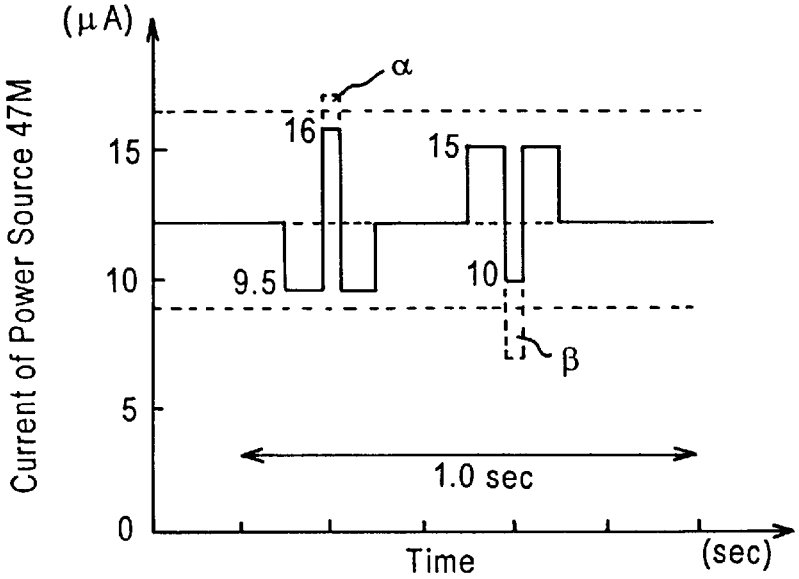
FIG. 6 shows the transfer current change under the transfer voltage control of FIG. 5.

FIG. 6 shows the measurement of transfer voltage change when the aforesaid transfer voltage control is executed during solid image transfer. Between the two parallel dashed lines in the drawing is the region in which the transfer voltage produces an excellent image with a transfer efficiency of 85% or higher; it can be understood that the change in transfer current is the range of excellent image production including the time of separation of the trailing edge of transfer sheet S from the transfer position of the upstream image processing unit 40C, and the time of entrance of the leading edge of transfer sheet S in the transfer position of the downstream image processing unit 40Y.

Figure 7:
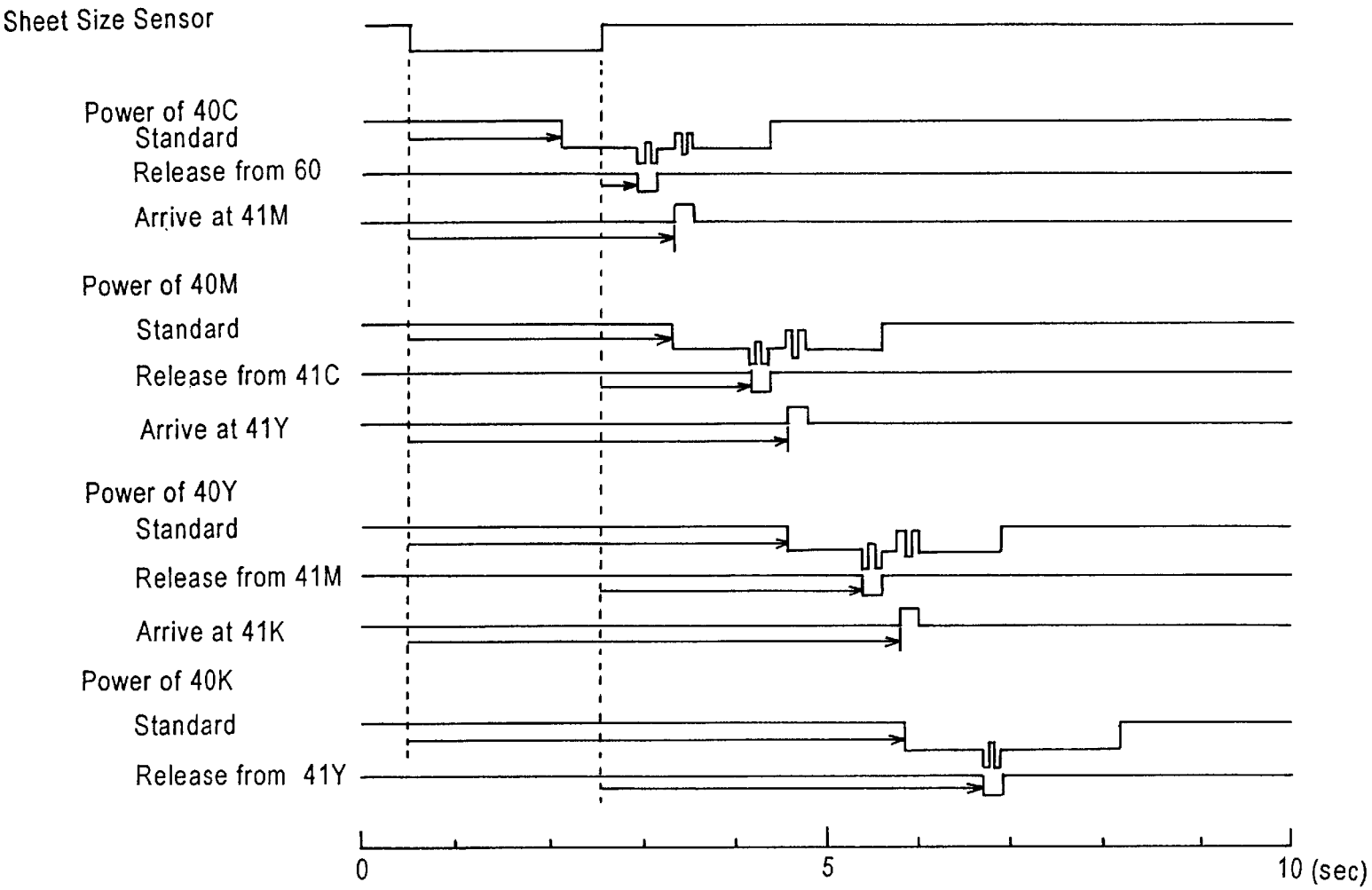
FIG. 7 is a timing chart for transfer voltage and timing control between photosensitive drums 41C–41K and transfer rollers 46C–46K of image processing units 40C–40K.
Figure 14:
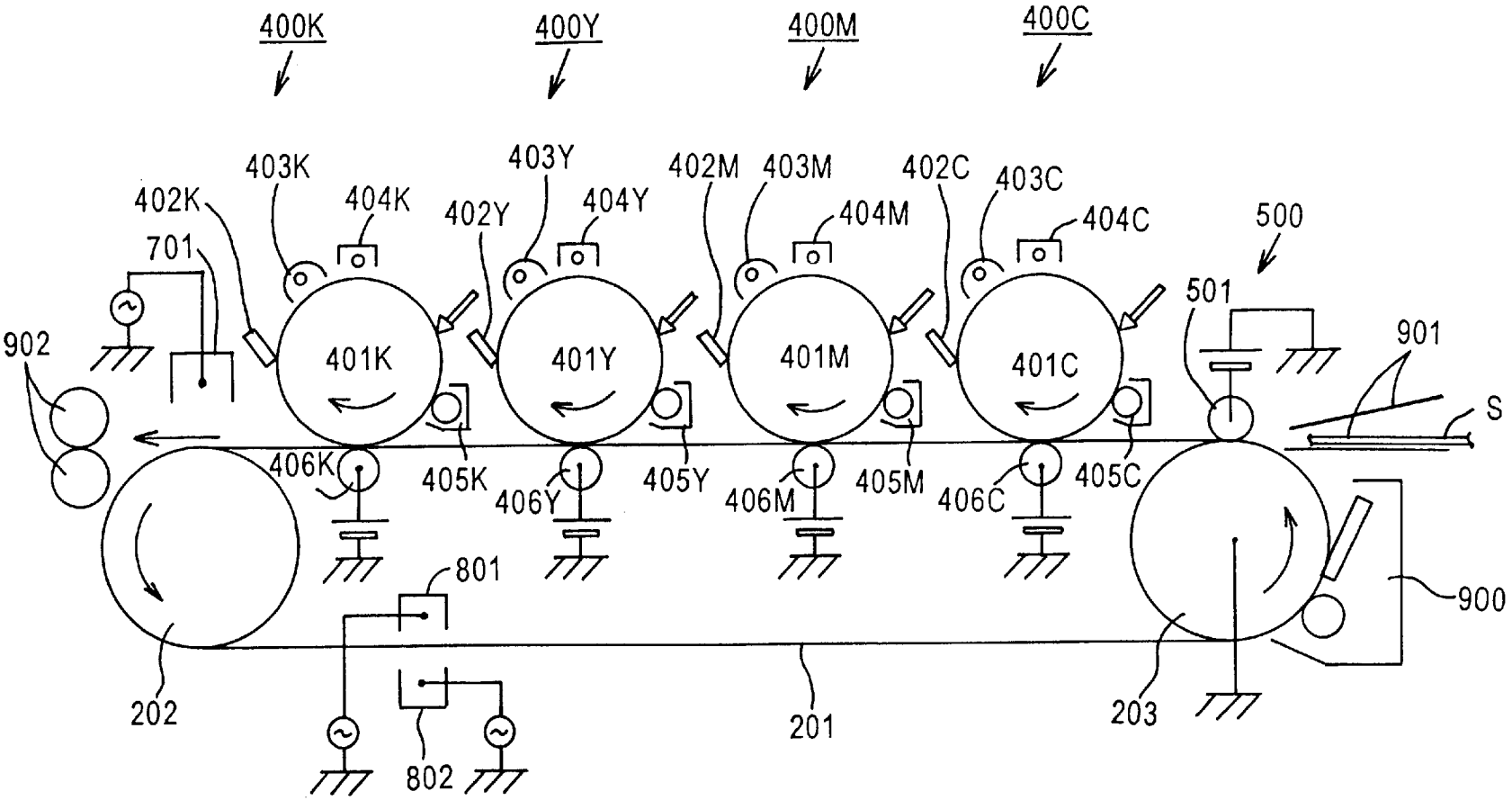
FIG. 14 briefly shows the general construction of a tandem type image forming apparatus.
Figure 15:
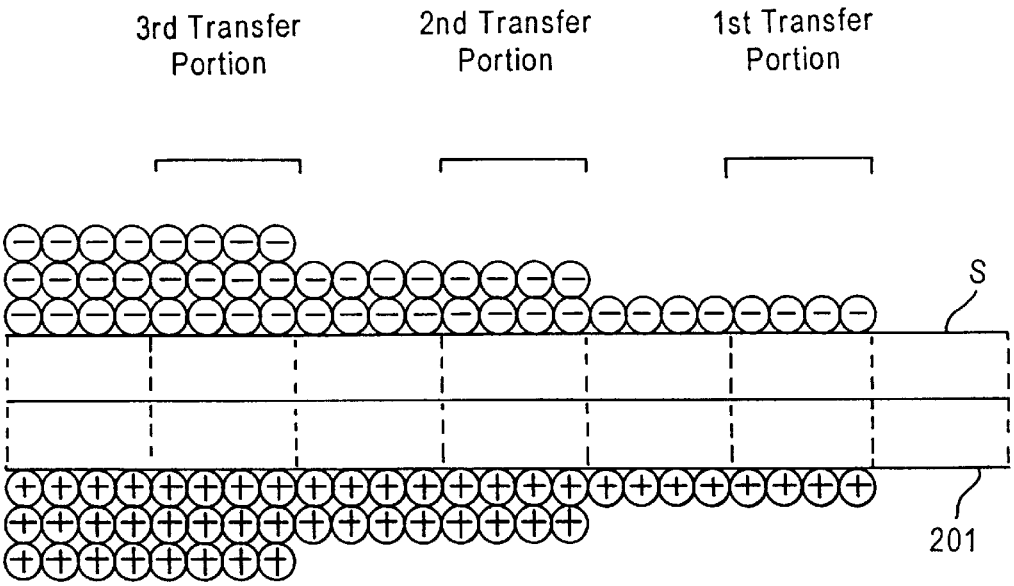
FIG. 15 illustrates the charge distribution in the transfer areas in the regular state of no impedance fluctuation in the tandem type image forming apparatus.
Figure 16A:
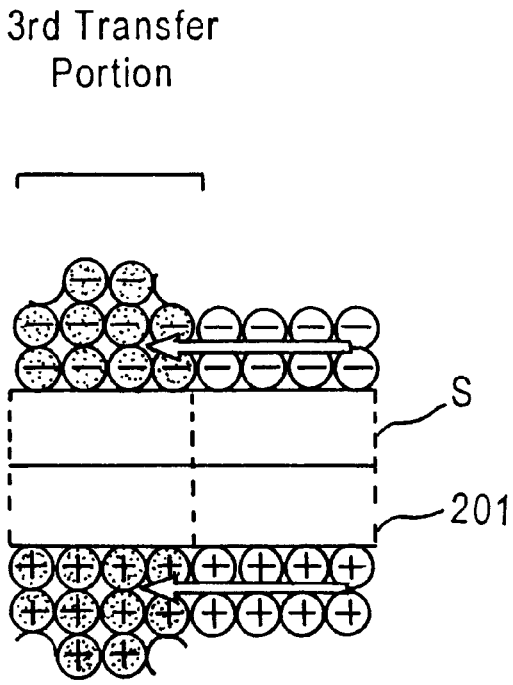
FIG. 16(*a*) shows the change in impedance of a downstream transfer area when a transfer sheet separates from an upstream transfer area.
Figure 16B:
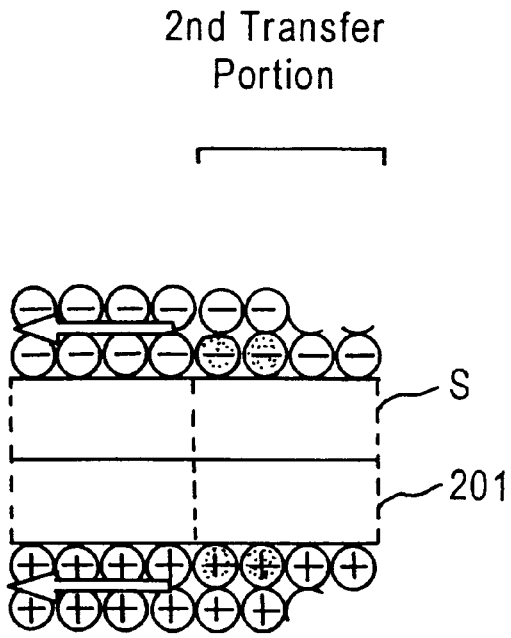

If the transfer voltage is set beforehand based on Equation 1 when the trailing edge of transfer sheet S separates from the transfer position of the upstream image processing unit 40C, the transfer current becomes excessive as shown at α in the drawing due to the impedance rise, thereby generating incomplete transfer. If the transfer voltage is set beforehand based on Equation 1 when the leading edge of transfer sheet S enters the transfer position of the downstream image processing unit 40Y, the transfer current becomes too small as shown at β in the drawing due to the impedance drop, thereby generating incomplete transfer. FIG. 7 shows the control of the timing and transfer voltage between photosensitive drums 41C–41K and transfer rollers 46C–46K of image processing units 40C–40K determined by Equations 1–12 above. The aforesaid transfer voltage and timing controls from C–K color images and transfer said images in overlay transfer onto transfer sheet S without transfer irregularities.

Although the aforesaid example pertains to a transfer sheet S between the transfer positions of two image processing units, an A4 size transfer sheet S may straddle the transfer positions of three or four image processing units, such that the change in impedance between the photosensitive drums and transfer rollers of each image processing unit is affected only when separating from or entering the transfer position of adjacent directly upstream or directly downstream image processing units and is unaffected only when separating from or entering the transfer positions of image processing units farther upstream or downstream; for example, even when straddling the transfer positions of three or four image processing units, the same transfer voltage controls are executed for transfer power sources 47C–47K as when transfer sheet S straddles the transfer positions of two image processing units simply by shifting the timing.

(4) Modifications

Although the image forming apparatus of a first embodiment of the present invention has been described above, the content of the present invention is not limited to this embodiment and may be variously modified as described below.

Whereas the change in impedance was detected when the leading edge of the transfer sheet S in sheet adhesion unit 50 enters the impedance detection position of impedance detection unit 60 in the aforesaid embodiment, the change in impedance also may be detected when the leading edge of the transfer sheet S in impedance detection unit 60 enters the transfer position of image processing unit 40C.

Furthermore, whereas a single impedance detection means is used together with sheet adhesion unit 50 in the aforesaid embodiment, it is to be noted that sheet adhesion means 50 may be provided with a separate impedance detection means.

Still further, whereas the change in impedance is detected by sheet adhesion unit 50 and impedance detection unit 60 in the aforesaid embodiment, it is to be noted that the change in impedance may be detected by measuring the transfer current and transfer voltage between photosensitive drums 41C–41K and transfer rollers 46C–46K when proof printing, said impedance change being fed back in subsequent printing to control transfer output.

Second Embodiment

A second embodiment of the present invention is described below.

In the first embodiment the transfer voltage value is calculated for the change in impedance caused by a sheet entering or leaving an adjacent transfer area and the regular transfer voltage (i.e., transfer voltage when the impedance is unchanged) based on the power source voltage of adhesion unit 50 and impedance detection unit 60, detection of humidity by environment sensor SE3, and the size of transfer sheet S in the transport direction, and transfer sequence (C, M, Y, K sequence), but the transfer voltage may also be set without such calculation by, for example, preparing beforehand a table of suitable transfer voltage values. Two examples of use of the aforesaid table are described below.

(1) Example 1 Using a Table

In the resent embodiment, the regular transfer voltage is extracted from a regular transfer voltage table prepared beforehand by means of information regarding environment sensor SE3, set paper type, and transfer sequence. The set paper type, for example, can be entered in the CPU by switch input or the like not shown in the drawing. An example of specific content of the table used in this mode is shown in FIG. 18. In practice, the specific transfer voltage values are set at field entries for C1, M1, Y1, and K1 and the like.

In the regular transfer voltage table shown in the drawing, the absolute humidity is set at 12 levels, paper type is set at 3 types, and the transfer sequence is set at 4 types (C, M, Y, K). Paper type is divided into 3 categories of plain paper (weight less than 90 g/m2), heavy paper (weight 90 g/m2 or greater), and OHP.

For example, when plain paper is used with an absolute humidity of 12 g/m2, the regular transfer voltages for C, M, Y, K derived from the table are C5, M5, Y5, K5.

The table can be similarly created beforehand even for transfer voltages when the impedance fluctuates. In this instance, the transfer voltage changes depending on the aforesaid three criteria of absolute moisture paper type, and transfer sequence, and additionally the size of the transfer sheet S in the transport direction. That is, a table is generated for each paper type of greater than 297 mm, 210–297 mm, and less than 210 mm. FIG. 9 shows an example of the content of transfer voltage table for separation from an adjacent transfer area of the present embodiment of the invention; FIG. 10 shows an example of the content of transfer voltage table for entrance to an adjacent transfer area.

When the aforesaid method is used, the power source voltage detection means of impedance detection unit 60 and adhesion unit 50 of the first embodiment is unnecessary. In the method of the present embodiment, there is some shifting from an optimum transfer voltage because the moisture absorption state of transfer sheet S is not directly detected.

(2) Example 2 Using a Table

In addition to the aforesaid example, the transfer voltage can be set by adding the assumed impedance of the transfer sheet S based on the power source voltage of adhesion unit 50. In this instance, an example of the content of part of the regular transfer voltage table is shown in FIG. 11. Actually, a table such as that in the drawing is prepared beforehand for each absolute humidity divided into 12 levels. In the present embodiment, the regular voltage setting is based on impedance detection by adhesion unit 50, but since impedance detection is affected by the size of the transfer sheet, the table also is divided into sheet size categories.

FIGS. 12 and 13 shows examples of the content of part of a table used when impedance fluctuates in the present embodiment. FIG. 12 shows an example of the content of transfer voltage table for separation from an adjacent transfer area of the present embodiment of the invention; FIG. 13 shows an example of the content of transfer voltage table for entrance to an adjacent transfer area. Similar to the regular table, values for each absolute humidity are unnecessary.

In the method of the present embodiment, impedance detection unit 60 is unnecessary and since the moisture absorption state of the transfer sheet S is detected directly, the precision of the transfer voltage setting is higher than that of the first embodiment. Since there is no need to directly detected impedance fluctuation, the precision of the voltage setting during impedance detection is inferior to methods using calculations.

(3) Table Content

Two examples of using a table to set the transfer voltage have been discussed above.

In these discussions specific numerical values were not used in the tables, but the trend of numerical values is discussed below. When considering a low order transfer voltage, the transfer voltage increases in order as the sheet resistance increases with the paper type, i.e., plain paper, thick paper, and OHP, such that the amount of correction of the transfer voltage also increases when the impedance fluctuates. The transfer voltage increases as the absolute humidity decreases, such that the amount of correction of the transfer voltage also increases when the impedance fluctuates. When the transfer sequence is in the order of cyan, magenta, yellow, black, the transfer voltage increases as the transfer sequence slows, such that the transfer voltage increases as the power source voltage of adhesion unit 50 increases.

In this instance it is possible to reduce the number of tables to less than that of the methods of the aforesaid two examples. If used under environmental conditions of extremely stable humidity, it is unnecessary to use the detection result of environment sensor SE3, and a previously prepared table can be used under this condition of constant humidity. If only a single type of paper is used, only the table for plain paper need be used, for example.

The aforesaid embodiments are described hereinafter in situations using a table and not using a table. Although the transfer voltage was invariably controlled in the preceding embodiments, it is also possible to control the transfer current in accordance with impedance fluctuations.

The content of the above examples can be applied, for example to various image forming apparatuses which electrostatically transfer or move charged particles such as a toner to a transfer member, such as copiers, printers and the like.

The image forming apparatus of the aforesaid embodiments of the present invention controls the transfer output in accordance with the change in impedance in transfer areas dependent on the timing of each transfer, thereby producing excellent images without transfer irregularities regardless of the impedance fluctuation dependent on transfer timing, and preventing enlargement of the apparatus.

Since an impedance detection unit for detecting changes in the combined impedance of a transport belt and transfer sheet is provided upstream from the farthest upstream image processing unit among a plurality of image processing units, the transfer output can be controlled in real time without print proofing.

Furthermore, if at least one among a detection means for detecting humidity and an input means for inputting paper type are provided, the transfer output can be controlled in accordance with changes in impedance based on at least one among the humidity detected by said detection means or paper type input by said input means, thereby controlling the transfer output without actually measuring the change in impedance.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

a plurality of image forming units for forming a plurality of toner images;

a transfer device for sequentially transferring said plurality of toner images onto the same transfer member via a predetermined transfer output in a plurality of transfer areas;

a controller for controlling the transfer output of said transfer device in accordance with the change in impedance of a transfer area dependent on the timing of each transfer, a transfer member transporting device for transporting said transfer member sequentially past the transfer areas of said transfer device; and an impedance detection unit positioned upstream from the transfer area on the farthest upstream side of said transfer member in the direction of transport so as to control the transfer output of said transfer device via said controller in accordance with a detected impedance value.

2. The image forming apparatus claimed in claim 1 further comprising:

a humidity detecting means for controlling transfer output of said transfer device via said controller in accordance with a detected humidity.

3. The image forming apparatus claimed in claim 1 further comprising:

a transfer member specifying device for specifying the type of transfer member to control the transfer output of said transfer device via said controller in accordance with the specified type of transfer member.

4. An image forming apparatus comprising:

a plurality of image forming units for forming a plurality of toner images;

a transfer device for sequentially transferring said plurality of toner images onto the same transfer member via a predetermined transfer output in a plurality of transfer areas; and a controller for controlling the transfer output of said transfer device in accordance with the change in impedance of a transfer area dependent on the timing of each transfer, wherein the change in impedance of a transfer area dependent on the timing of each transfer is a rise in impedance when the trailing edge of said transfer member separates from an upstream transfer area.

5. An image forming apparatus comprising:

a plurality of image forming units for forming a plurality of toner images;

a transfer device for sequentially transferring said plurality of toner images onto the same transfer member via a predetermined transfer output in a plurality of transfer areas; and a controller for controlling the transfer output of said transfer device in accordance with the change in impedance of a transfer area dependent on the timing of each transfer, wherein the change in impedance of a transfer area dependent on the timing of each transfer is a drop in impedance when the leading edge of said transfer member enters a downstream transfer area.

6. An image forming apparatus comprising:

a plurality of image forming units for forming a plurality of toner images;

a transfer device for sequentially transferring said plurality of toner images onto the same transfer member via a predetermined transfer output in a plurality of transfer areas; and a controller for changing the transfer output in accordance with a previously prepared table stored in memory expressing the relationship between the change in impedance and transfer output.

7. The image forming apparatus claimed in claim 6, wherein said table is classified by various sizes of transfer media.

8. The image forming apparatus claimed in claim 6, wherein said table is classified by absolute humidity values.

9. The image forming apparatus claimed in claim 6, wherein said table is classified by the transfer sequence for transferring a plurality of toner images.

10. The image forming apparatus claimed in claim 6, wherein said table is classified by the transfer sequence for transferring a plurality of toner images and absolute humidity, and size of transfer media.

11. The image forming apparatus claimed in claim 6, wherein the change in impedance of a transfer area dependent on the timing of each transfer is a rise in impedance when the trailing edge of said transfer member separates from an upstream transfer area.

12. The image forming apparatus claimed in claim 6, wherein the change in impedance of a transfer area dependent on the timing of each transfer is a drop in impedance when the leading edge of said transfer member enters an downstream transfer area.

13. A method of forming an image, said method comprising the steps of:

forming a plurality of toner images;

sequentially transferring said plurality of toner images onto a same transfer member via a predetermined transfer output in a plurality of transfer areas;

controlling the transfer output of a transfer device in accordance with the change in impedance of a transfer area dependent on the timing of each transfer, transporting said transfer member sequentially past the transfer areas of said transfer device;

detecting an impedance value via an impedance detection unit positioned upstream from the transfer area on the farthest upstream side of said transfer member in the direction of transport; and controlling the transfer output of said transfer device via said controller in accordance with said detected impedance value.

14. The method of claim 13, further comprising the step of:

controlling transfer output of said transfer device via said controller in accordance with a detected humidity determined by a humidity detecting means.

15. The method of claim 13, further comprising the step of:

specifying the type of transfer member to control the transfer output of said transfer device via said controller, said type of transfer member specified by a transfer member specifying device.

16. A method of forming an image, said method comprising the steps of:

forming a plurality of toner images;

sequentially transferring said plurality of toner images onto a same transfer member via a predetermined transfer output in a plurality of transfer areas; and controlling the transfer output of a transfer device in accordance with the change in impedance of a transfer area dependent on the timing of each transfer, wherein the change in impedance of a transfer area dependent on the timing of each transfer is a rise in impedance when the trailing edge of said transfer member separates from an upstream transfer area.

17. A method of forming an image, said method comprising the steps of:

forming a plurality of toner images;

sequentially transferring said plurality of toner images onto a same transfer member via a predetermined transfer output in a plurality of transfer areas; and controlling the transfer output of a transfer device in accordance with the change in impedance of a transfer area dependent on the timing of each transfer, wherein the change in impedance of a transfer area dependent on the timing of each transfer is a drop in impedance when the leading edge of said transfer member enters a downstream transfer area.

18. A method of forming an image, said method comprising the steps of:

forming a plurality of toner images;

sequentially transferring said plurality of toner images onto a same transfer member via a predetermined transfer output in a plurality of transfer areas; and changing the transfer output in accordance with a previously prepared table stored in memory expressing a relationship between the change in impedance and transfer output.

19. The method of claim 18, wherein said table is classified by various sizes of transfer media.

20. The method of claim 18, wherein said table is classified by absolute humidity values.

21. The method of claim 18, wherein said table is classified by the transfer sequence for transferring a plurality of toner images.

22. The method of claim 18, wherein said table is classified by the transfer sequence for transferring a plurality of toner images and absolute humidity values, and size of transfer media.

23. The method of claim 18, wherein the change in impedance of a transfer area dependent on the timing of each transfer is a rise in impedance when the trailing edge of said transfer member separates from an upstream transfer area.

24. The method of claim 18, wherein the change in impedance of a transfer area dependent on the timing of each transfer is a drop in impedance when the leading edge of said transfer member enters a downstream transfer area.

* * * * *